US006256265B1

(12) United States Patent
Sepulveda

(10) Patent No.: US 6,256,265 B1
(45) Date of Patent: Jul. 3, 2001

(54) TIME DISPLAY

(76) Inventor: Richard J. Sepulveda, 1911 Lockwood Ave., Fremont, CA (US) 94539-4657

( * ) Notice: Subject to any disclaimer, the term of this patent is extended or adjusted under 35 U.S.C. 154(b) by 0 days.

(21) Appl. No.: 09/413,476

(22) Filed: Oct. 6, 1999

(51) Int. Cl.[7] ..... G04C 19/00; G04C 17/00
(52) U.S. Cl. ..... 368/82; 368/239
(58) Field of Search ..... 368/82–84, 107–109, 368/223, 239–242

(56) References Cited

U.S. PATENT DOCUMENTS 3,574,992 4/1971 Ladas .
3,772,874 11/1973 Lefkowitz .
3,775,964 * 12/1973 Fukumoto ..... 368/240
4,161,098 * 7/1979 Ingendahl ..... 368/239
4,979,155 12/1990 Tung .
5,199,006 3/1993 Ferrara .
5,214,624 5/1993 Siebrasse .
5,331,609 7/1994 Gubin .
5,487,053 1/1996 Beiswenger et al. .
5,526,327 6/1996 Cordova, Jr. .
5,694,376 12/1997 Sullivan .
5,757,731 5/1998 Rosenberg .
5,896,348 4/1999 Lyon .

* cited by examiner

*Primary Examiner*—Vit Miska
(74) *Attorney, Agent, or Firm*—Jerome D. Jackson

(57) ABSTRACT

A clock display having two linear parts. The first part has 6 positions for indicating the hours 1–6. Hour indications on the second part progress toward the position for hour 1 on the first part.

31 Claims, 19 Drawing Sheets

TIME DISPLAY

BACKGROUND OF THE INVENTION

1. Field of the Invention

This invention relates generally to a time display and, more specifically, to a time display for legibly indicating the time in an esthetically pleasing manner.

2. Description of Related Art

Time measurement technology has had steady progress in accuracy and efficiency, especially since the advent of electronics. Time display technology, however, has had no corresponding progress. The traditional clock face, having hour and minute hands progressing about a circular path, has been in continuous use for several hundred years. The traditional clock face is universally recognized, but is incongruous in certain contemporary settings, such as a offices and homes decorated in certain modern styles. Digital displays are also universally recognized, but are also incongruous in certain settings.

Various types of alternate time displays have been proposed. A problem with many of these alternate displays, however, is difficulty of interpretation.

SUMMARY OF THE INVENTION

It is an object of the present invention to provide a time display for legibly indicating the time in an esthetically pleasing manner.

To achieve this and other objects of the present invention, a clock system comprises a first display part with positions for indicating the hours 1–6, including a first position for indicating the hour 1, the first display part defining a first line; a second display part with positions for indicating the hours 7–12, respectively the second display part defining a second line substantially parallel to the first line, wherein a distance between the first position and the positions of the second display part is a decreasing function of the time corresponding to the positions of the second display part; and a signal generator coupled to the first display part and to the second display part.

According to another aspect of the present invention, there is a method of operating a clock system including a first display part with a first position for indicating the hour 1, the first display part defining a first line, a second display part with positions for indicating the hours 7–12, the second display part defining a second line substantially parallel to the first line. The method comprises the steps of generating a first signal to cause the first display part to indicate the hours 1–6; and generating a second signal to cause the second display to indicate time, such that a distance between the first position and the positions of the second display part is a decreasing function of the time corresponding to the positions of the second display part.

According to yet another aspect of the present invention, a clock system comprises: a first display part with a first position for indicating the hour 1, the first display part defining a first line; a second display part with positions for indicating the hours 7–12, the second display part defining a second line substantially parallel to the first line; means for generating a first signal to cause the first display part to indicate the hours 1–6; means for generating a second signal to cause the second display to indicate time, such that a distance between the first position and the positions of the second display part is a decreasing function of the time corresponding to the positions of the second display part.

According to yet another aspect of the present invention, a clock system comprises a plurality of first display areas for displaying minutes, each first display area defining a first polygon; and a plurality of second display areas for displaying second, each second display area defining a polygon overlapping one of the first polygons.

The accompanying drawings which are incorporated in and which constitute a part of this specification, illustrate embodiments of the invention and, together with the description, explain the principles of the invention, and additional advantages thereof. Throughout the drawings, corresponding parts are labeled with corresponding reference numbers.

DESCRIPTION OF THE PREFERRED EMBODIMENTS

First Embodiment

Figure 1:
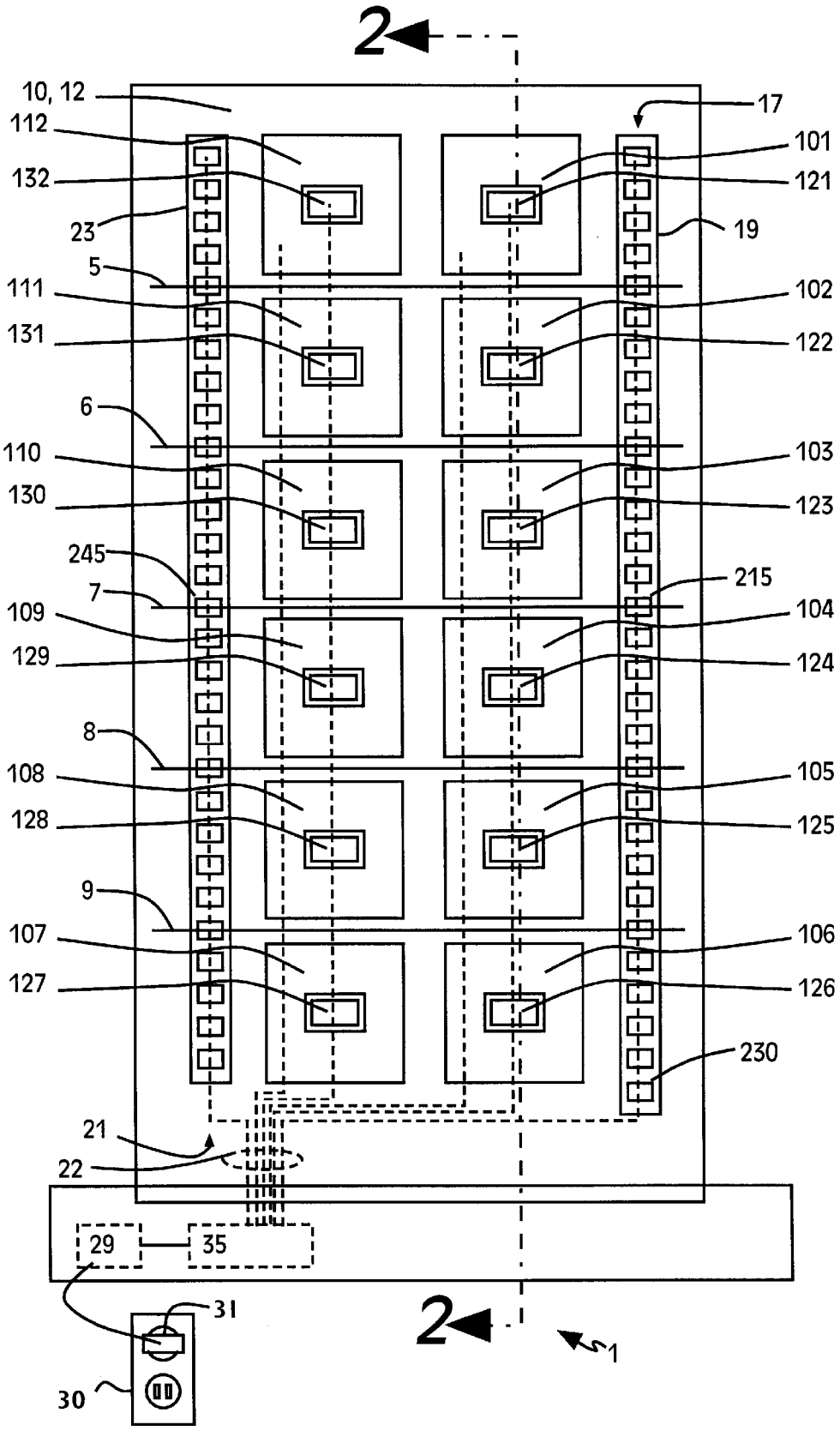
FIG. 1 is a front view of a clock in accordance with a first preferred embodiment of the present invention.
Figure 2:
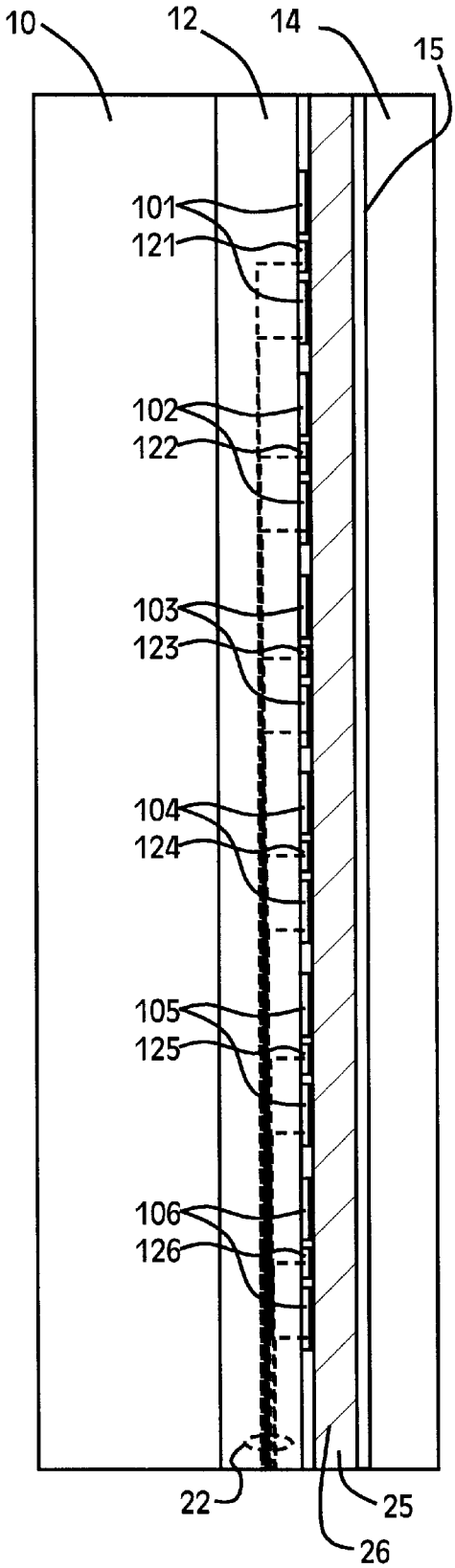
FIG. 2 is a cross-sectional view taken along the line 2—2 in FIG. 1.

FIG. 1 is a front view of clock 1, and FIG. 2 is a side view of clock 1 taken along the line 2—2 in FIG. 1. Clock 1 includes glass plate 10 and hour electrodes 101, 102, 103, 104, 105, 106, 107, 108, 109, 110, 111, and 112 for indicating the hours of the day 1–12 respectively. Electrodes 101, 102, 103, 104, 105, and 106 define a column for indicating the hours 1–6 respectively. Electrodes 107, 108, 109, 110, 111, 112 define another column for indicating the hours 7–12 respectively.

Glass plate 10 includes visible etching 19 and visible etching 23. Visible etching 19 frames electrode group 17 including 30 electrodes for indicating the minutes 1–30 respectively. Electrode group 17 includes minute electrode 215 for indicating minute 15 of the hour, and minute electrode 230 for indicating minute 30 of the hour.

Visible etching 23 frames electrode group 21 including 29 electrodes for indicating the minutes 31–59 respectively. Electrode group 21 includes minute electrode 245 for indicating minute 45 of the hour.

In other words, clock 1 includes 59 positions corresponding to electrode group 17 and electrode group 21, surrounding the hour positions, for indicating the minutes 1–59, respectively. Positions 1–30 define an outer right column, with position 1 at the top of the column and position 30 at the bottom of the column. Positions 31–59 define a left outer column, with position 31 at the bottom of the column and position 59 at the top of the column. The presence of a rectangle, in one of the positions, indicates that the minute is greater than or equal to the position number.

Glass plate 10 includes horizontal visible etchings 5, 6, 7, 8, and 9 spaced in increments of 5 time units. Visible etching 5 intersects the visual path from the electrode for displaying minute 5 in group 17 and the electrode for displaying minute 55 in group 21. Visible etching 6 intersects the visual path from the electrode for displaying minute 10 in group 17 and the electrode for displaying minute 50 in group 21. Visible etching 7 intersects the visual path from the electrode for displaying minute 15 in group 17 and the electrode for displaying minute 45 in group 21. Visible etching 8 intersects the visual path from the electrode for displaying minute 20 in group 17 and the electrode for displaying minute 40 in group 21. Visible etching 9 intersects the visual path from the electrode for displaying minute 25 in group 17 and the electrode for displaying minute 35 in group 21.

AC-DC converter 29 receives power from 60 Hz wall socket 30 via plug 31. AC-DC converter 29 supplies a DC power signal to time processing circuitry 35. Clock 1 includes a backup battery (not shown) to preserve the time in event of temporary disruption of the power from socket 30.

In this Patent Application, the word circuitry encompasses both dedicated hardware and programmable hardware, such as a microprocessor CPU or reconfigurable logic array, in combination with programming data, such as sequentially fetched CPU instructions or programming data for a reconfigurable array.

Time processing circuitry 35 is electrically coupled to each of electrodes 101 through 112, 121 through 132, the electrodes in electrode group 17, and the electrodes in electrode group 21, via electrically conductive signal paths 22 in glass plate 12.

Glass plate 10 defines a thickness of approximately 0.5 inches.

Glass plate 12 is relatively thin and is bonded to glass plate 10. Each of electrode groups 17 and 21; hour electrodes 101, 102, 103, 104, 105, 106, 107, 108, 109, 110, 111 and 112; and PM electrodes 121, 122, 123, 124, 125, 126, 127, 128, 129, 130, 131, and 132 is on glass plate 12.

Each hour electrode surrounds a respective PM electrode. Hour electrode 101 surrounds PM electrode 121. Hour electrode 102 surrounds PM electrode 122. Hour electrode 103 surrounds PM electrode 123. Hour electrode 104 surrounds PM electrode 124. Hour electrode 105 surrounds PM electrode 125. Hour electrode 106 surrounds PM electrode 126. Hour electrode 107 surrounds PM electrode 127. Hour electrode 108 surrounds PM electrode 128. Hour electrode 109 surrounds PM electrode 129. Hour electrode 110 surrounds PM electrode 130. Hour electrode 111 surrounds PM electrode 131. Hour electrode 112 surrounds PM electrode 132.

Glass plate 14 is bonded to glass plate 12 to define a chamber 25 between glass plate 12 and glass plate 14. Liquid crystal material 26, designated by hatch marks, occupies chamber 25. Common electrode 15 is on glass plate 14. Common electrode 15 is electrically connected to AC-DC converter 29.

Figure 3:
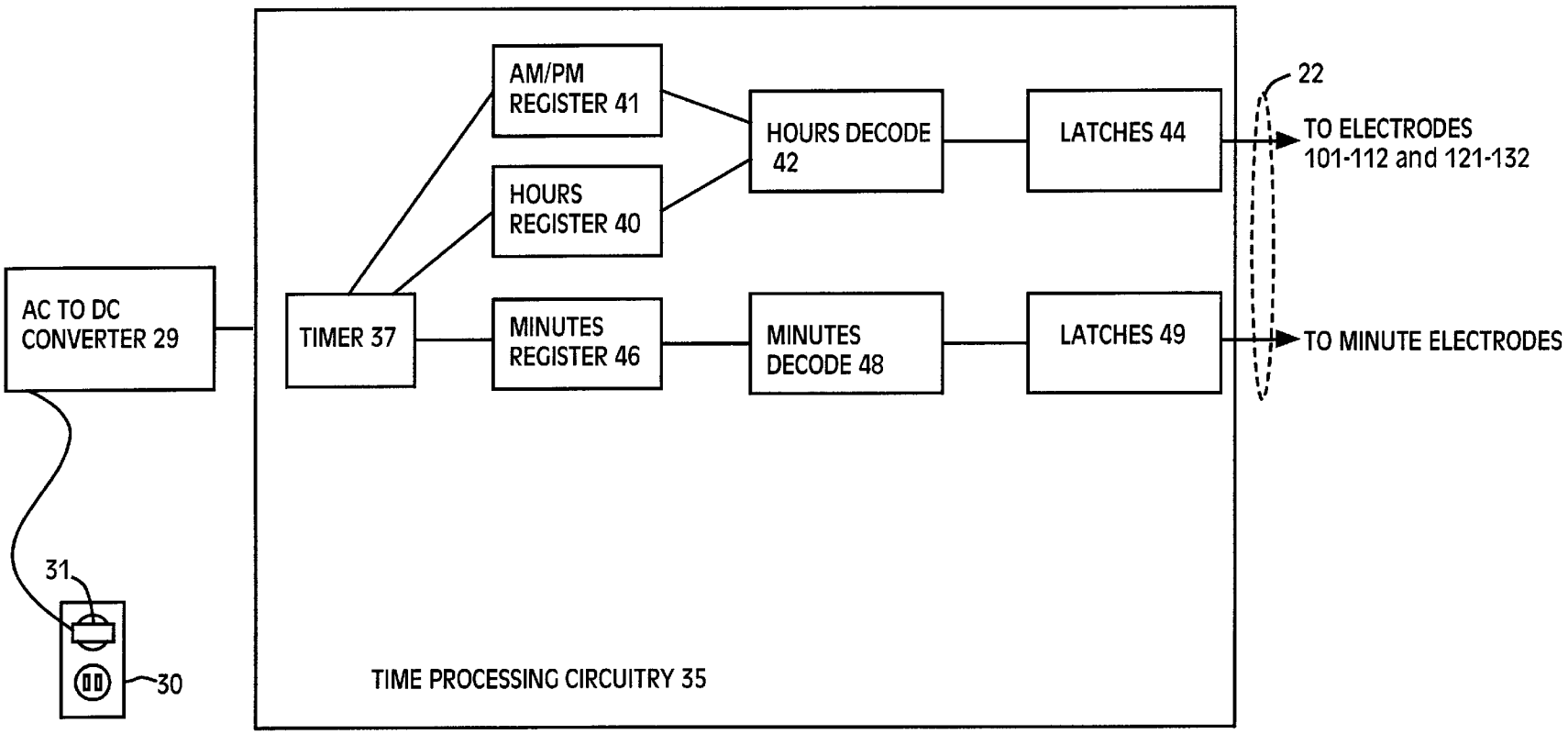
FIG. 3 is a block diagram of some circuitry in the first preferred clock.

FIG. 3 shows time processing circuitry 35 in more detail. Timer module 37 maintains hours register 40 with the current hour, in the range 1–12. Timer module 37 maintains AM/PM register 41 with a 0 indicating AM and a 1 indicating PM. Hours decode module 42 decodes the values of hours register 40 and AM/PM register 41 to address and write values into hours latches 44. Hours latches 44 include 12 latches for asserting voltages on hours electrodes 101–112 respectively. Hours latches 44 also includes 12 latches for asserting voltages on PM electrodes 121–132 respectively.

Timer module 37 maintains minutes register 46 with the current minute, in the range 1–59. Minute decode module 48 decodes the values of minutes register 46 and to address and write values into minutes latches 49. Minutes latches 49 includes 59 latches: 30 latches for asserting voltages on the 30 electrodes in group 17 respectively, and 29 latches for asserting voltages on the 29 electrodes in group 21 respectively.

For the first embodiment of the present invention, it is presently preferred that timer module 37, hours register 40, AM/PM register 41, hours decode module 42, minutes register 46, and minute decode module 48 be implemented with general purpose microprocessor CPU and instructions executed by the CPU.

Figure 4:
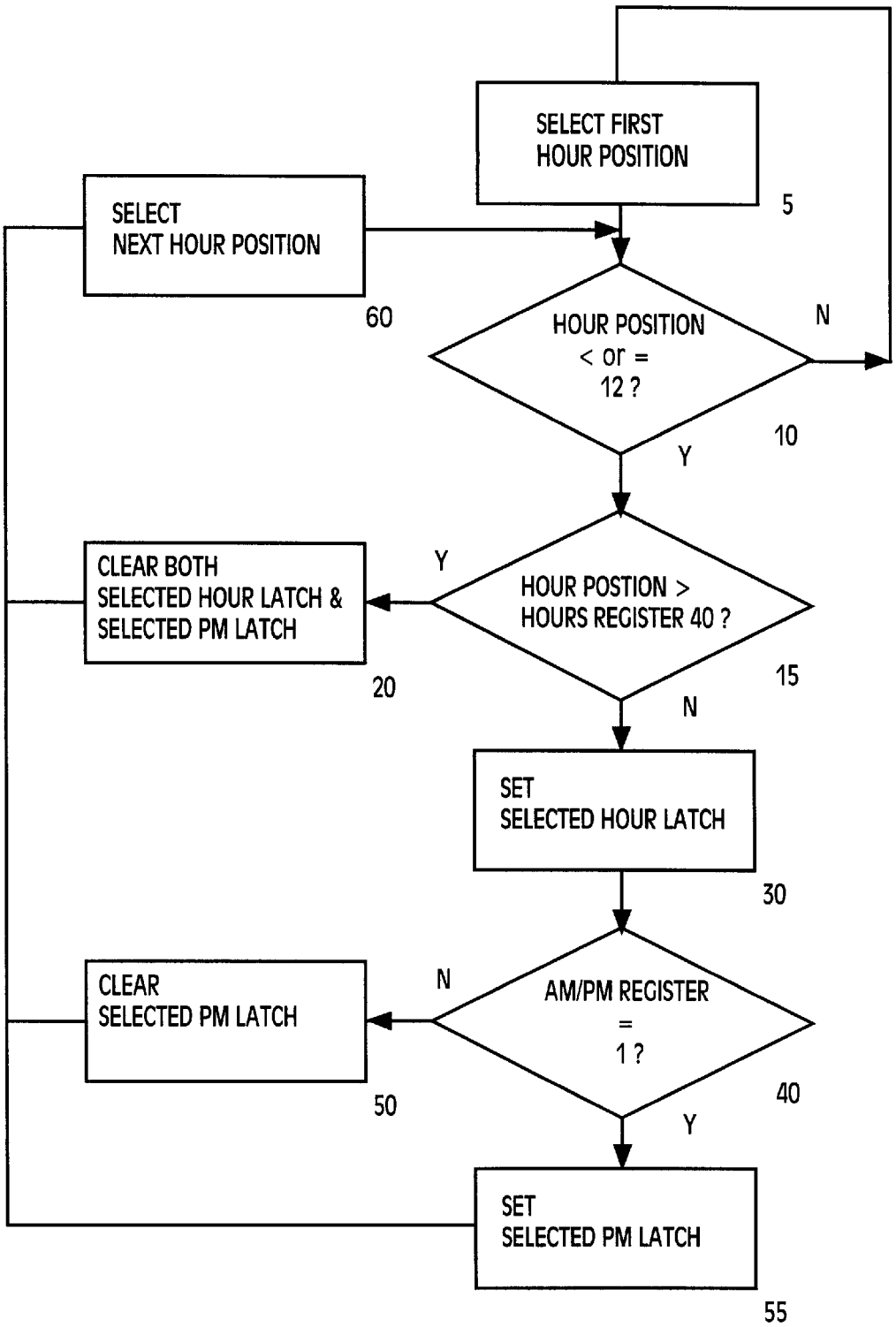
FIG. 4 is a flow chart expressing the functionality of a process performed by the circuitry shown in FIG. 3.

FIG. 4 shows a process performed by hours decode module 42. Decode module 42 selects a first hour position by setting a variable HOUR_POSITION equal to 1 (Step 5). Decode module 42 compares the current value of HOUR_POSITION to 12 (Step 10). If HOUR_POSITION is less than or equal to 12, decode module 42 compares HOUR_POSITION to the value in hours register 40 (Step 15). If the value of HOUR_POSITION is greater than the value in hours register 40, decode module 42 clears the latch driving the hours electrode for the position indicated by HOUR_POSITION (step 20). In other words, in terms of the numbering scheme of FIG. 1, step 20 clears the latch driving hours electrode 100+HOUR_POSITION.

Step 20 also writes a 0 into the latch driving the PM indicator for the hours position represented by HOUR_POSITION. In other words, step 20 writes a 0 into the latch driving PM electrode 120+HOUR_POSITION.

If HOUR_POSITION is not greater than the value in hours register 40, decode module 42 writes a 1 into the latch driving the hour electrode of the position indicated by HOUR_POSITION. In other words, decode module 42 writes a 1 into the latch driving electrode 100+HOUR_POSITION. (Step 30).

Decode module 42 compares AM/PM register 41 to 1 (Step 40). If AM/PM register 41 is not equal to 1, decode module 42 writes a 0 into the latch driving the PM indicator for the hours position represented by HOUR_POSITION (step 50). In other words, step 50 writes a 0 into the latch driving PM electrode 120+HOUR_POSITION.

If AM/PM register is equal to 1, decode module 42 writes a 1 into the latch driving the PM indicator for the hours position represented by HOUR_POSITION. In other words, decode module 42 writes a 1 into the latch driving electrode 120+HOUR_POSITION. (Step 55).

Decode module 42 adds a 1 to the value of HOUR_POSITION (Step 60) and passes control to step 10 for processing of any remaining hour positions.

Figure 5:
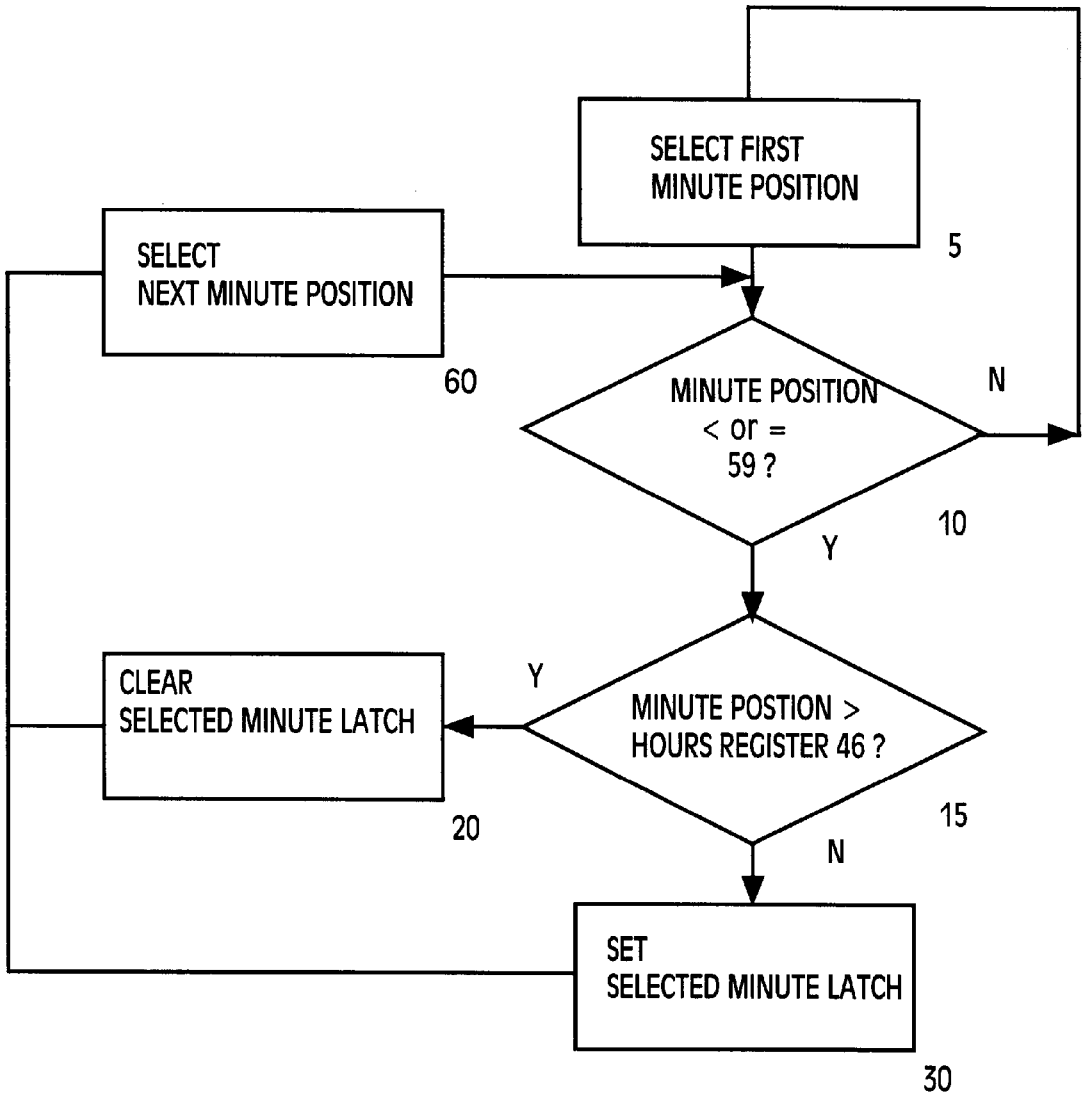
FIG. 5 is a flow chart expressing the functionality of another process performed by the circuitry shown in FIG. 3.

FIG. 5 expresses the functionality of minute decode module 48. Decode module 48 selects a first minute position by setting a variable MINUTE_POSITION equal to 1 (Step 5). Decode module 48 compares the current value of MINUTE_POSITION to 59 (Step 10). If MINUTE_POSITION is less than or equal to 59, decode module 48 compares MINUTE_POSITION to the value in minutes register 46 (Step 15). If the value of MINUTE_POSITION is greater than the value in minutes register 46, decode module 48 clears the latch driving the minute electrode for the position indicated by MINUTE_POSITION (step 20).

If MINUTE_POSITION is not greater than the value in minutes register 46, decode module 48 writes a 1 into the latch driving the minute electrode of the position indicated by MINUTE_POSITION. (Step 30).

Figure 6:
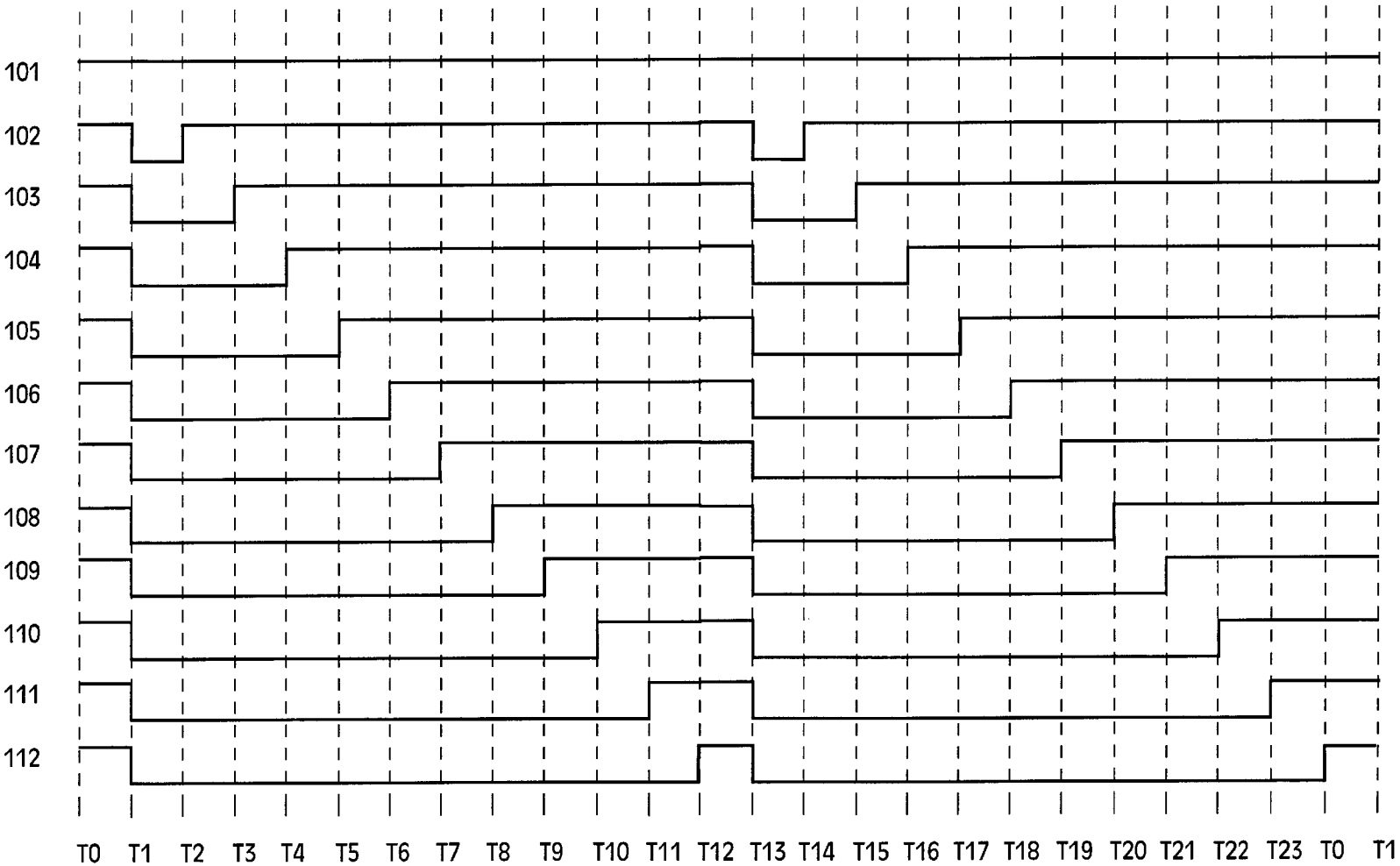
FIG. 6 is a timing diagram showing some signals generated by the circuitry shown in FIG. 3.

FIG. 6 is a timing diagram showing voltages applied to electrodes 101–112, over a 24 hour period. The upper voltage level caused that portion of liquid crystal 26 opposite the electrode to be opaque. A low voltage causes that portion of liquid crystal 26 opposite the electrode to be relatively transparent. T0 is 12 midnight, T1 is 1am, T2 is 2am, T3 is 3am, T4 is 4am, T5 is 5am, T6 is 6am, T7 is 7am, T8 is 8am, T9 is 9am, T10 is 10am, T11 is 11pm, T12 is noon, T13 is 1pm, T14 is 2pm, T15 is 3pm, T16 is 4pm, T17 is 5pm, T18 is 6pm, T19 is 7pm, T20 is 8pm, T21 is 9pm, T22 is 10pm, and T23 is 11pm.

As shown at T1, the display area of electrodes 102–112 are caused to be transparent. The display area for electrode 101 is always opaque.

At a time T2, the display area for electrode 102 is caused to be opaque and to remain opaque until a time T13. At a time T3, the display area for electrode 103 is caused to be opaque, and to remain opaque until a time T13. At a time T4, the display area for electrode 104 is caused to be opaque, and to remain opaque until a time T13. At a time T5, the display area for electrode 105 is caused to be opaque, and to remain opaque until a time T13. At a time T6, the display area for electrode 106 is caused to be opaque, and to remain opaque until a time T13. At a time T7, the display area for electrode 107 is caused to be opaque, and to remain opaque until a time T13. At a time T8, the display area for electrode 108 is caused to be opaque, and to remain opaque until a time T13. At a time T9, the display area for electrode 109 is caused to be opaque, and to remain opaque until a time T13. At a time T10, the display area for electrode 110 is caused to be opaque, and to remain opaque until a time T13. At a time T12, the display area for electrode 111 is caused to be opaque, and to remain opaque until a time T13. At a time T12, the display area for electrode 112 is caused to be opaque, and to remain opaque until a time T13.

The functionality of hours decode module 42 causes the duty cycle of electrodes 101–112 to be a decreasing function of hour position. For example, electrode 101 in hour position 1 in on 12/12 of the time. Electrode 102 in hour position 2 is on 11/12 of the time. Electrode 103 in hour position 3 is on 10/12 of the time. Electrode 104 in hour position 4 is on 9/12 of the time, etc.

Figure 7:
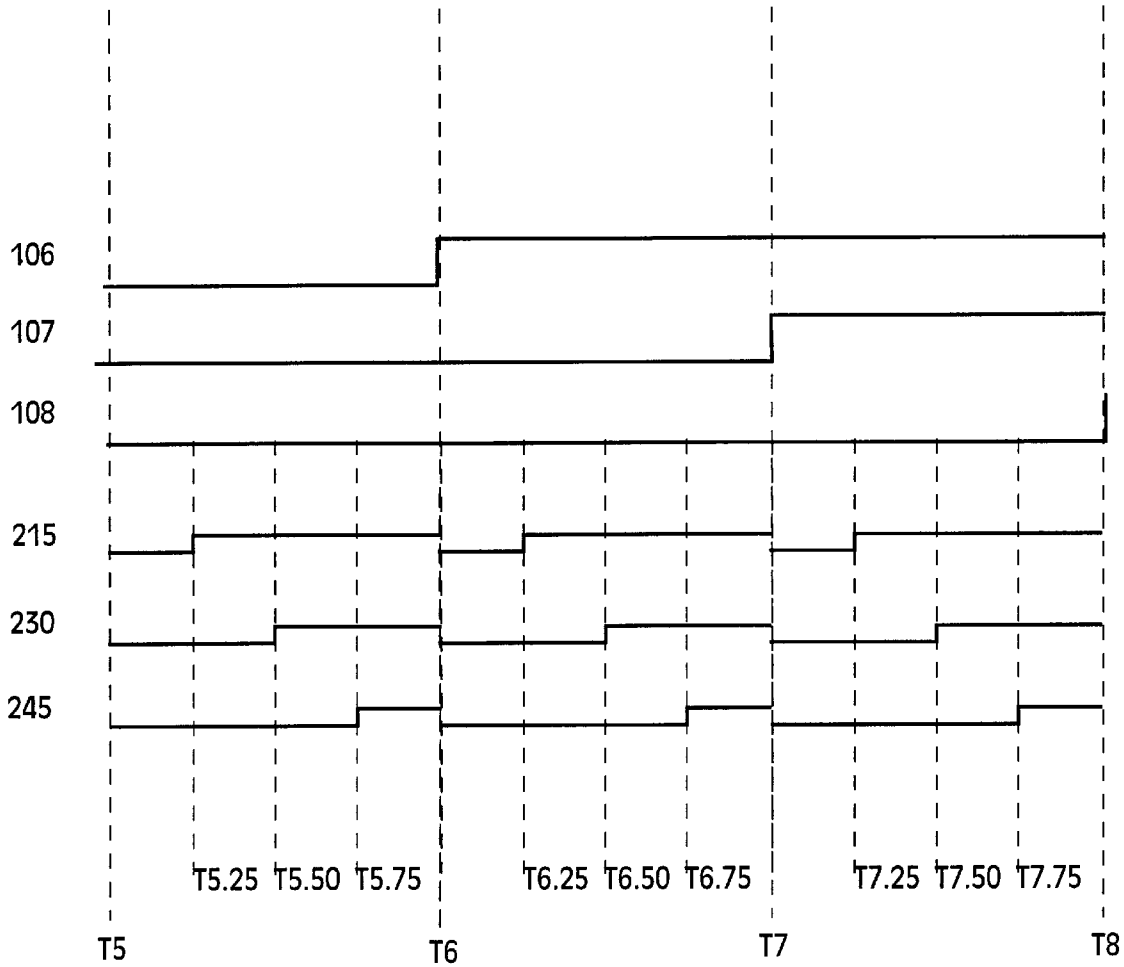
FIG. 7 is a timing diagram corresponding to a part of FIG. 6.

FIG. 7 is a diagram corresponding to a portion of FIG. 6 in more detail. FIG. 7 also shows voltages applied to minute electrode 215, minute electrode 230, and minute electrode 245. At a time T5, each of the display areas of the minute electrodes is caused to be transparent. For example, at T5 each of the display areas of minute electrodes 215, 230, and 245 is caused to be transparent.

At a time T5.25 (5:15am) the display area of minute electrode 215 is caused to be opaque and to remain opaque until time T6. At T5.50 (5:30am) the display area of minute electrode 230 is caused to be opaque and to remain opaque until time T6. At T5.75 (5:45am) the display area of minute electrode 245 is caused to be opaque and to remain opaque until a time T6.

Once a minute electrode is activated, the minute electrode remains activated until the beginning of the next hour. Thus, the functionality of minute decode module 48 causes the duty cycle of minute electrodes in electrode groups 17 and 21 to be a decreasing function of minute position. In other words, module 48 generates a signal to cause the number of displayed minute symbols to increase as function of time, until the beginning of the next hour.

Figure 8:
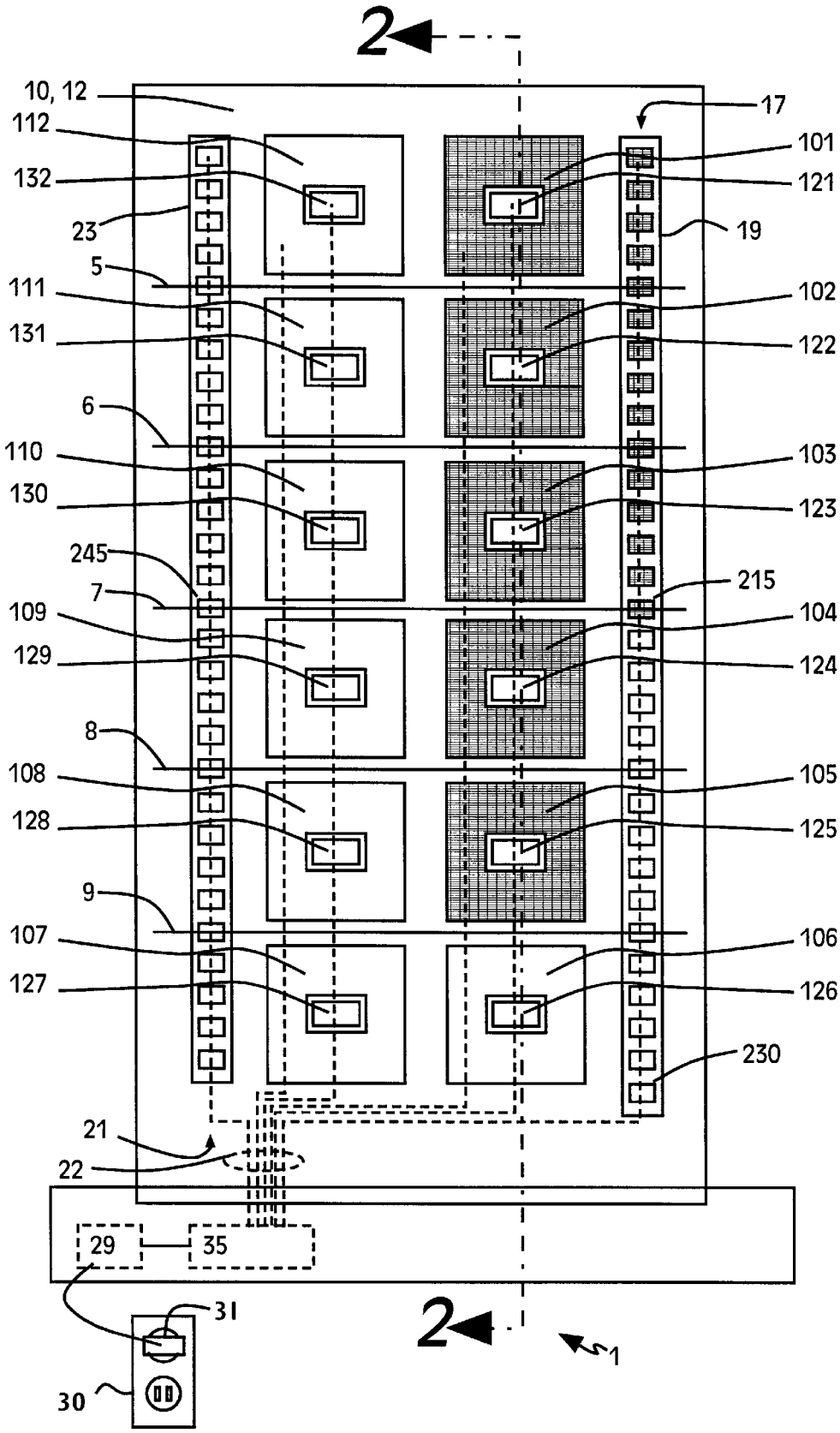
FIG. 8 is a view of the first preferred clock at a certain time.

FIG. 8 is a view of clock 1 at a time T5.25 shown in FIG. 7.

Figure 9:
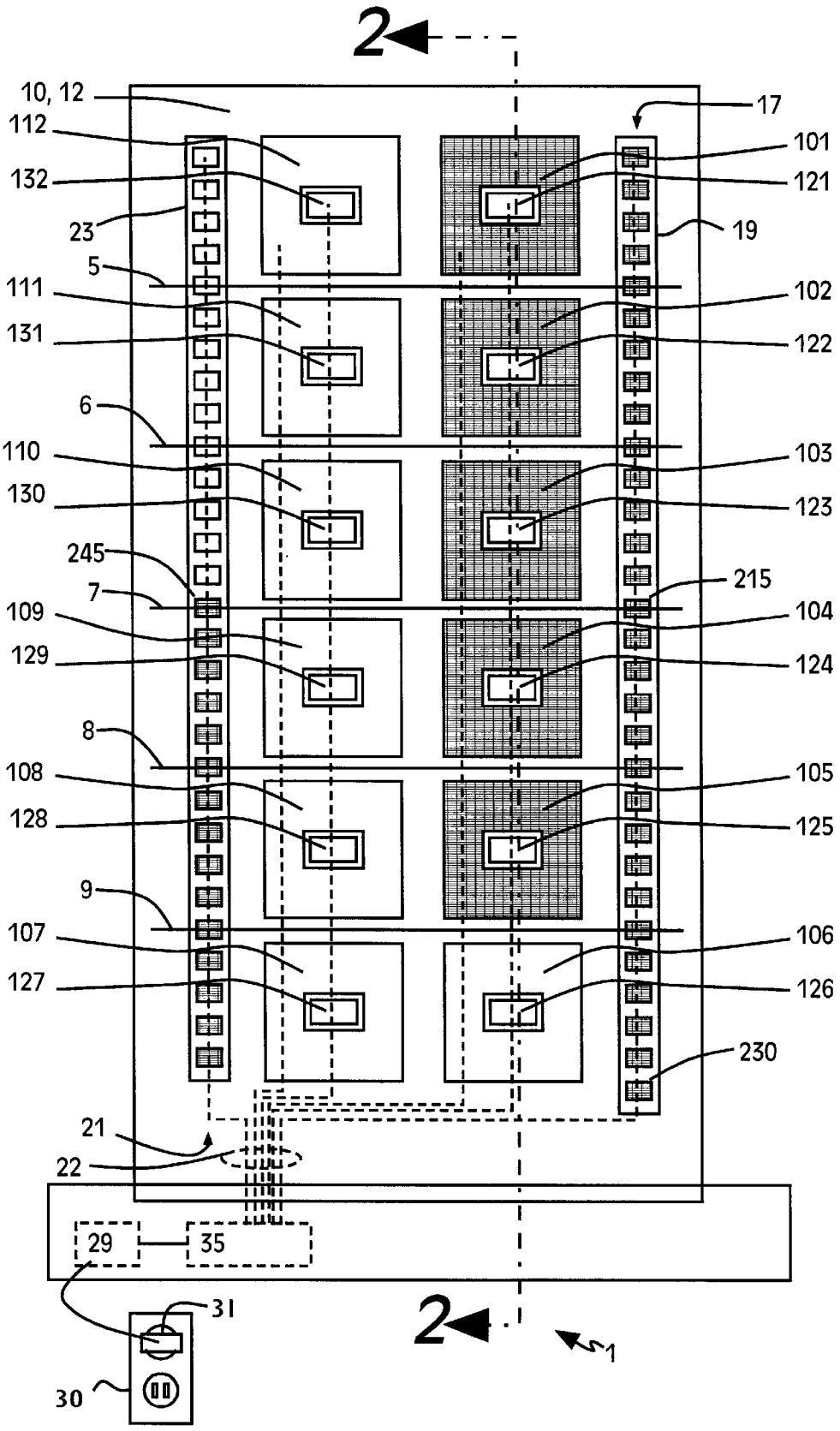
FIG. 9 is a view of the first preferred clock at a different time.

FIG. 9 is a view of clock 1 at a time T5.75 shown in FIG. 7.

Figure 10:
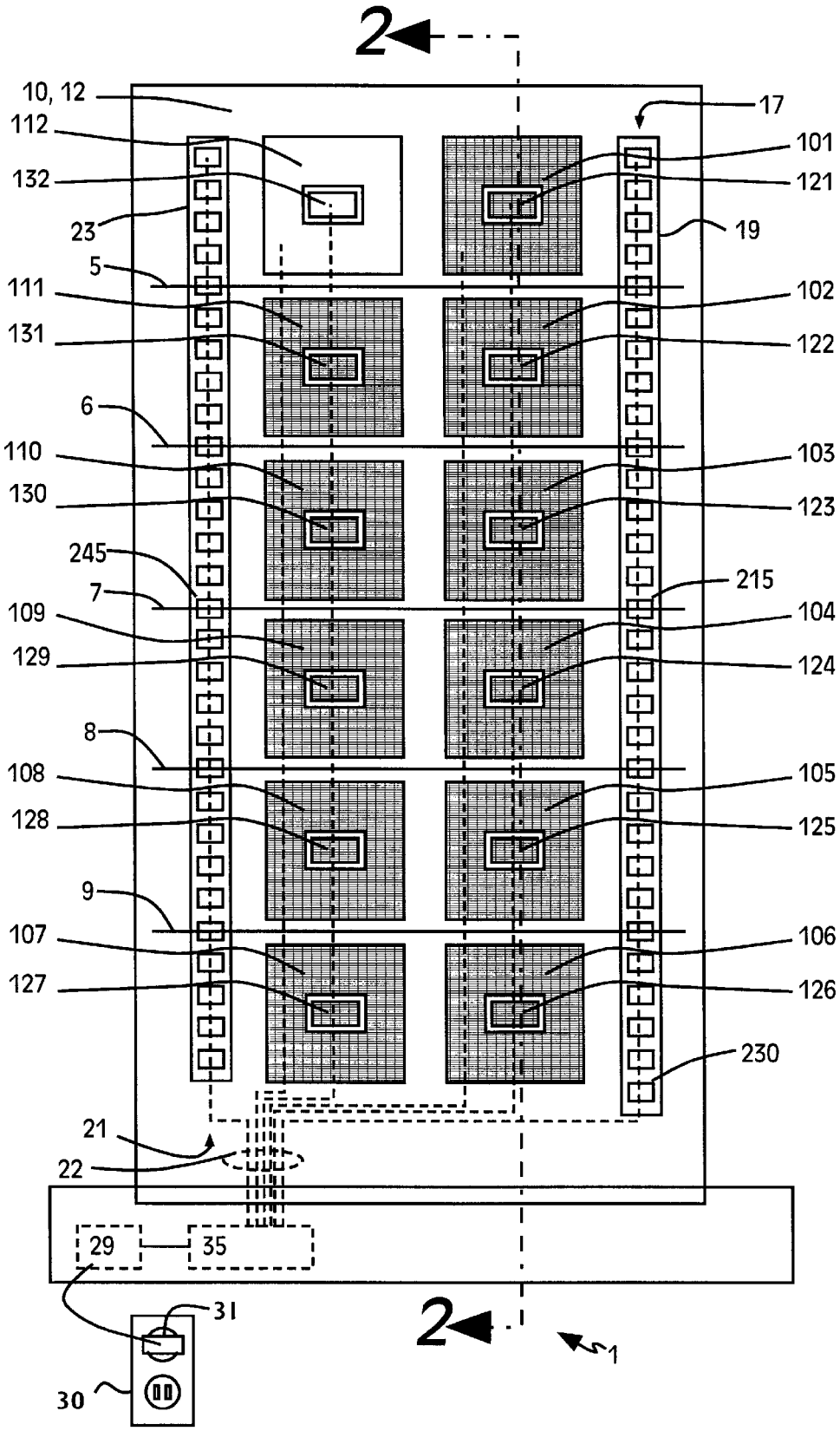
FIG. 10 is a view of the first preferred clock at still a different time.

FIG. 10 is a view of clock 1 at a time T23 shown in FIG. 6.

Second Embodiment

Figure 11:
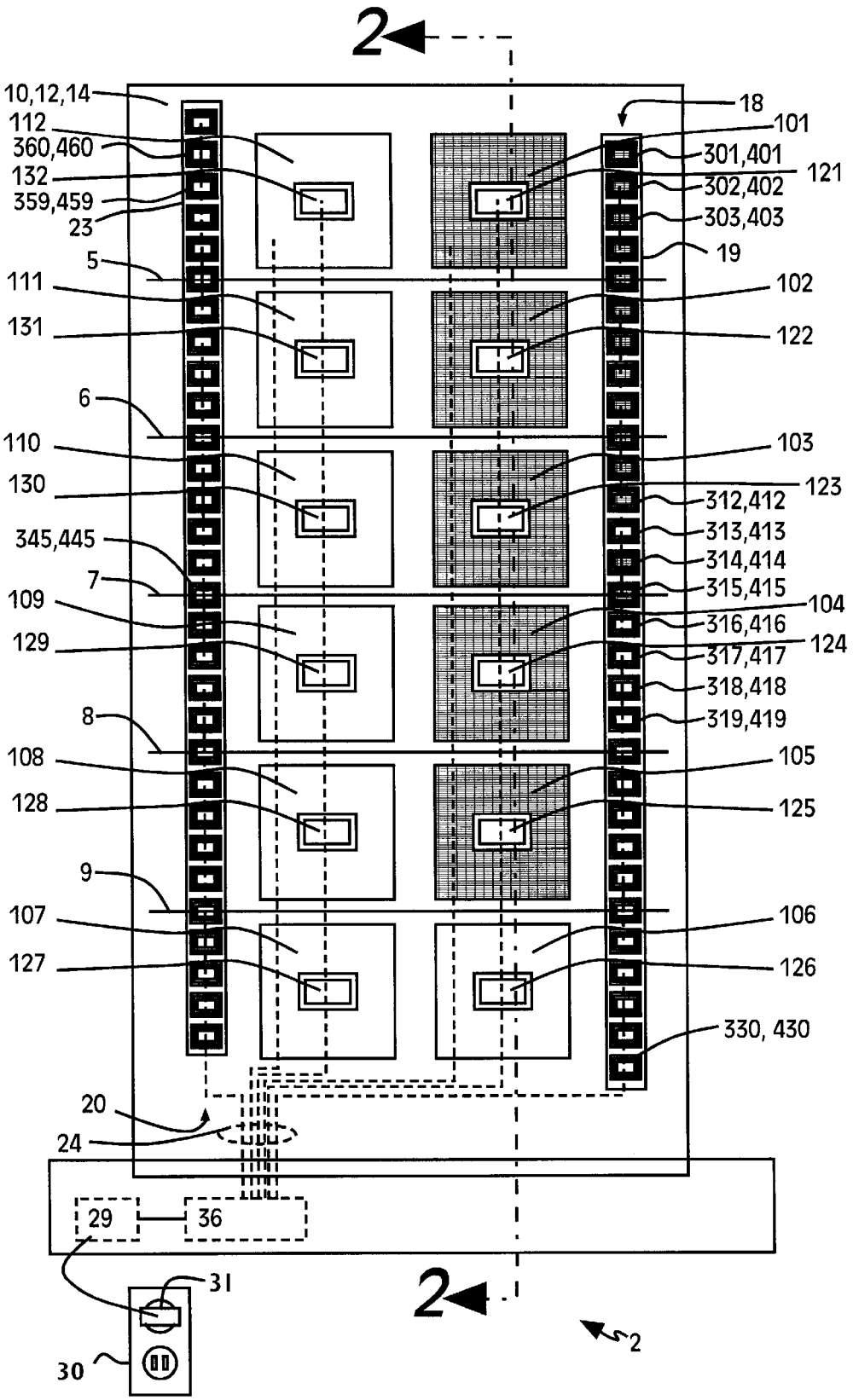
FIG. 11 is a view of a clock in accordance with a second preferred embodiment of the present invention.

FIG. 11 is a front view of clock 2. In FIG. 11, clock 2 is displaying of time of 5:15 AM and 13 seconds (5:15:13).

Glass plate 10 includes visible etching 19 and visible etching 23. Visible etching 19 frames electrode group 18 including 30 pairs of electrodes for indicating the minutes 1–30 respectively, and for indicating the seconds 1–30 respectively. For example, electrode group 18 includes a pair of electrodes 301 and 401 for indicating minute 1 of the hour and second 1 of the minute; a pair of electrodes 302 and 402 for indicating minute 2 of the hour and second 2 of the minute; a pair of electrodes 303 and 403 for indicating minute 3 of the hour and second 3 of the minute; a pair of electrodes 312 and 412 for indicating minute 12 of the hour and second 12 of the minute; a pair of electrodes 313 and 413 for indicating minute 13 of the hour and second 13 of the minute; a pair of electrodes 314 and 414 for indicating minute 14 of the hour and second 14 of the minute; a pair of electrodes 315 and 415 for indicating minute 15 of the hour and second 15 of the minute; a pair of electrodes 316 and 416 for indicating minute 16 of the hour and second 16 of the minute; a pair of electrodes 317 and 417 for indicating minute 17 of the hour and second 17 of the minute; a pair of electrodes 318 and 418 for indicating minute 18 of the hour and second 18 of the minute; a pair of electrodes 319 and 419 for indicating minute 19 of the hour and second 19 of the minute; and a pair of electrodes 330 and 430 for indicating minute 15 of the hour and second 15 of the minute.

Visible etching 23 frames electrode group 20 including 30 pairs of electrodes for indicating the minutes 31–59 respectively, and for indicating the seconds 31–60 respectively. For example, electrode group 20 includes a pair of electrodes 345 and 445 for indicating minute 45 of the hour and second 45 of the minute; a pair of electrodes 359 and 459 for indicating minute 59 of the hour and second 59 of the minute; and a pair of electrodes 360 and 460 for indicating second 60 of the minute.

Each of electrode groups 18 and 20 is on glass plate 12.

AC-DC converter 29 supplies a DC power signal to time processing circuitry 36. Time processing circuitry 36 is electrically coupled to each of electrodes 101 through 112, and 121 through 132 via electrically conductive signal paths 24 in glass plate 12. Time processing circuitry 36 is also electrically coupled to each of the electrodes in electrode group 18 via electrically conductive signal paths 24 in glass plate 12. Time processing circuitry 36 is also electrically coupled to each of the electrodes in electrode group 20 via electrically conductive signal paths 24 in glass plate 12.

Figure 12:
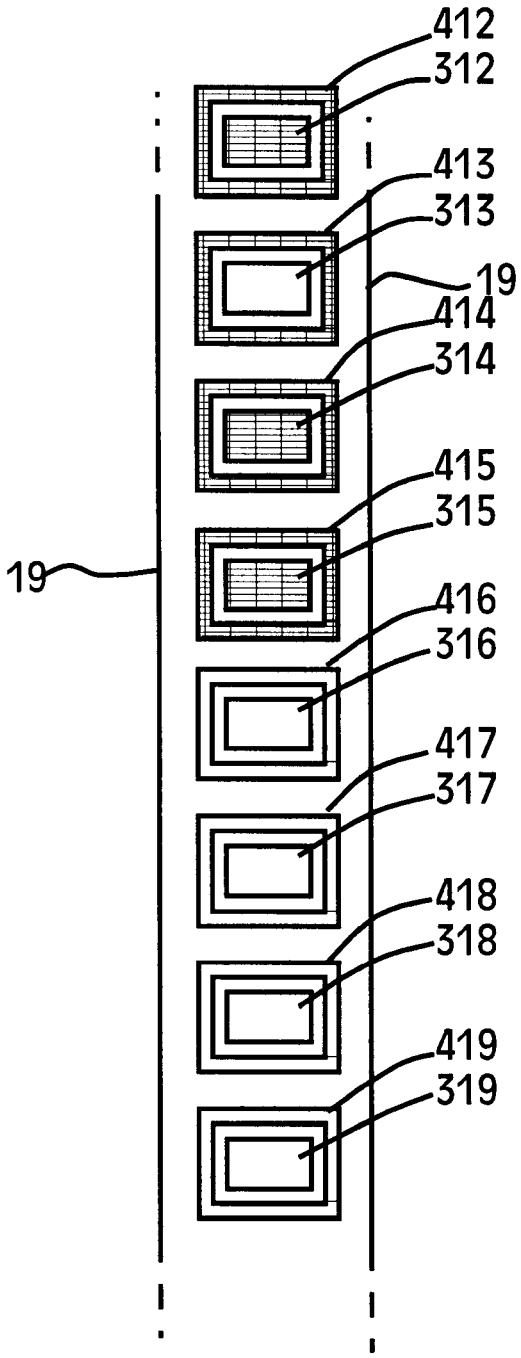
FIG. 12 is a an enlarged view of a portion of the visual display of the second preferred clock.

FIG. 12 shows some of the electrodes in electrode group 18 in more detail, displaying the time 5:15 AM and 13 seconds (5:15:13). Each pair of electrodes includes an outer electrode surrounding an inner electrode. For example, outer electrode 415 surrounds inner electrode 315.

Figure 13:
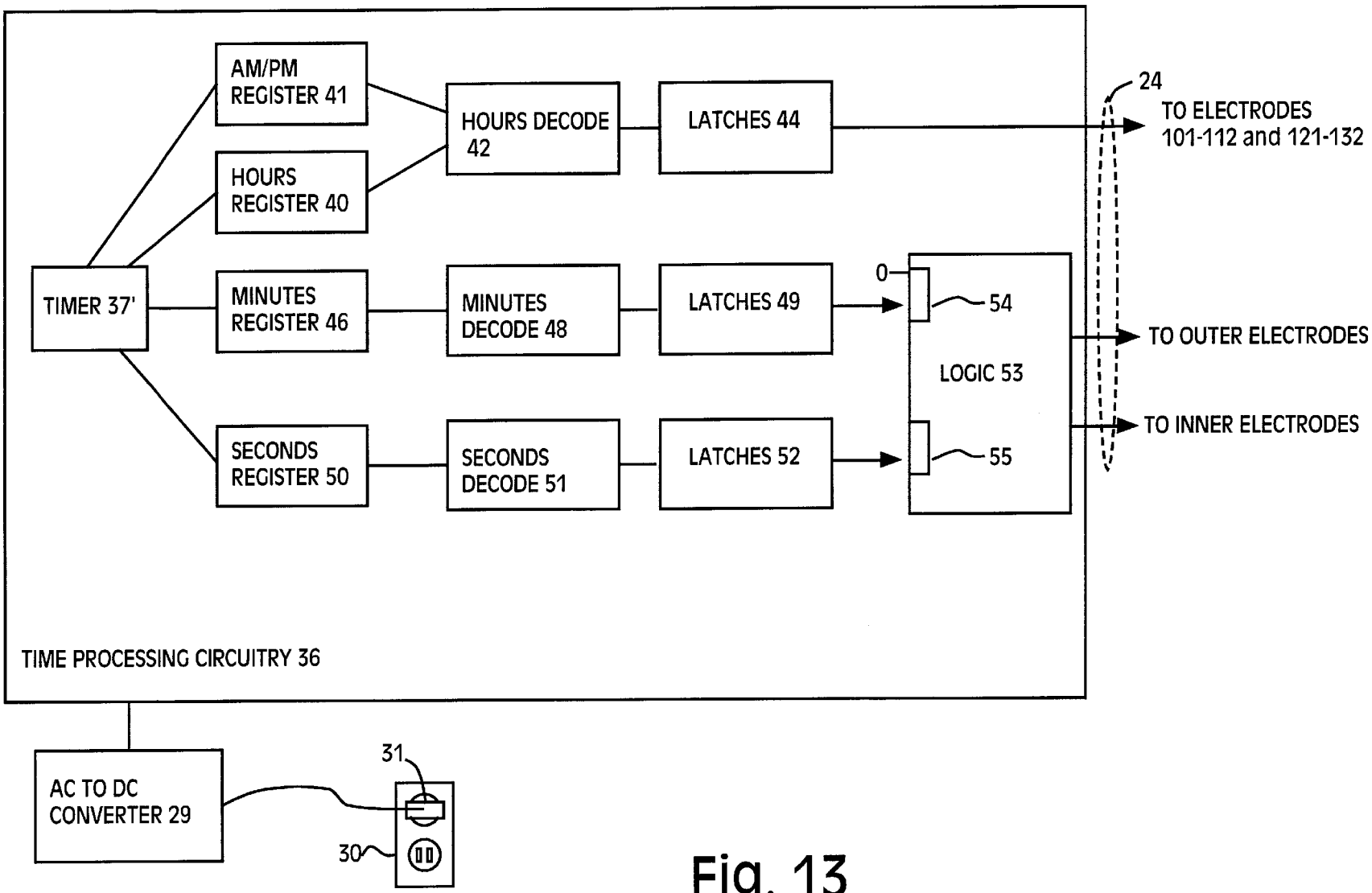
FIG. 13 is a block diagram of some circuitry in the second preferred clock.

FIG. 13 shows time processing circuitry 36 in more detail. Time processing circuitry 36 includes the features of circuitry 35 and also includes circuitry for driving the electrode pairs in electrode group 18 and electrode group 20. Logic 53 includes minutes inputs 54. Minutes inputs 54 include 60 inputs. Seconds inputs 55 includes 60 inputs.

Timer module 37' maintains minutes register 46 with the current minute, in the range 1–59. Minute decode module 48 decodes the values of minutes register 46 and to address and write values into minutes latches 49. Minutes latches 49 includes 59 latches for asserting voltages on 59 of minutes inputs 54 respectively. As shown in FIG. 13, the remaining minutes input 54 is always driven with a voltage indicating 0, because clock 2 never indicates minute 60.

Timer module 37' maintains seconds register 50 with the current second, in the range 1–60. Second decodes module 51 decodes the values of seconds register 50 and to address and write values into seconds latches 52. Seconds latches 52 includes 60 latches for asserting voltages on 60 of seconds inputs 55 respectively.

Figure 14:
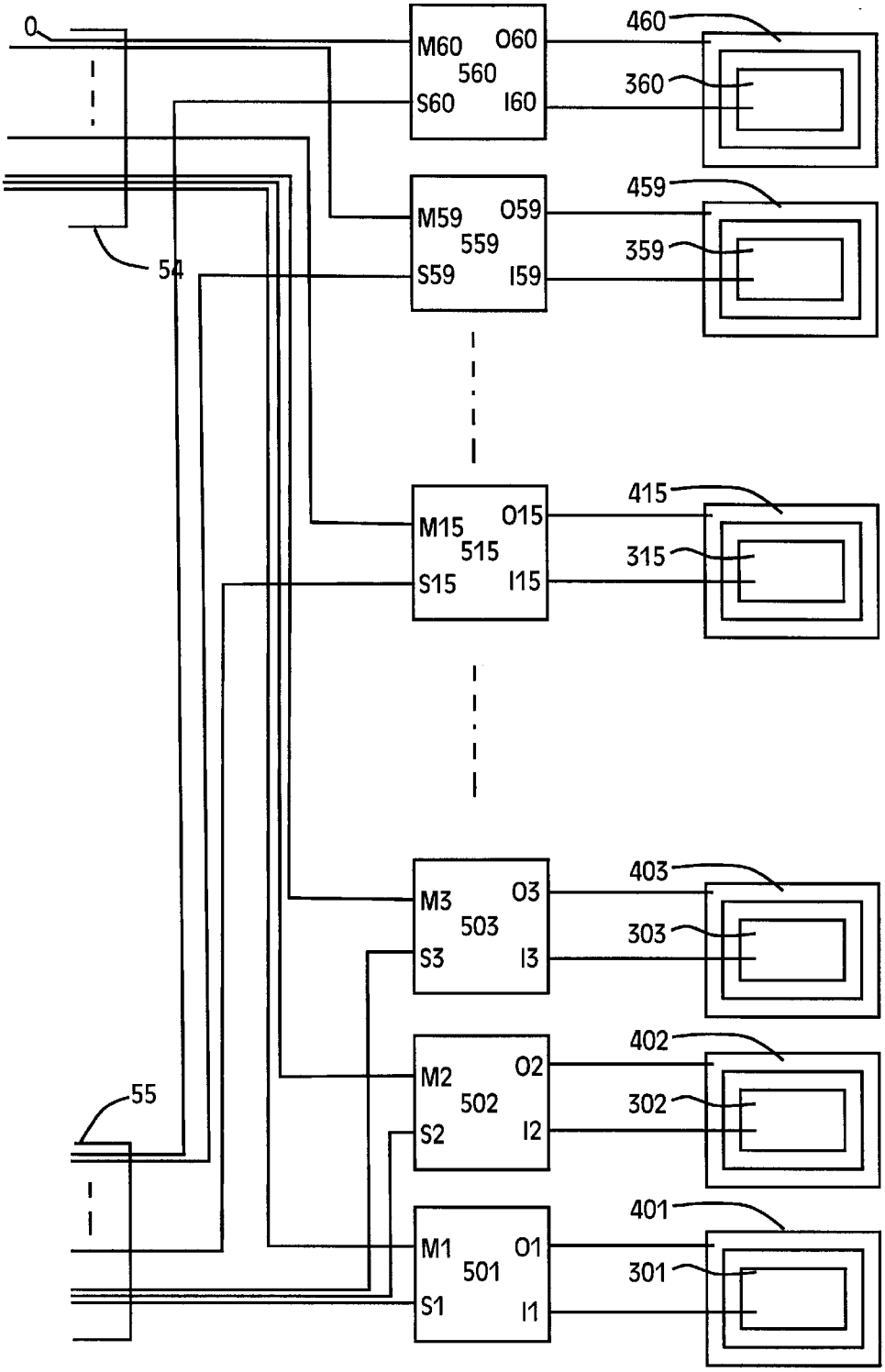
FIG. 14 is a block diagram of some circuitry shown in FIG. 13 in more detail.

FIG. 14 shows logic 53 in more detail and emphasizes signal paths between logic 53 and the electrodes. Logic 53 may be conceptualized as 60 modules for driving the 60 electrode pairs constituting electrode groups 18 and 20. Each module drives a respective electrode pair. For clarity, only 6 of the 60 modules are explicitly shown in FIG. 14.

Each logic module has a respective input Mi from minute inputs 54, and a respective input Si from seconds input 55. For example, logic module 501 has an input M1 from minutes inputs 54 and an input S1 from seconds input 55. Logic module 502 has an input M2 from minutes inputs 54 and an input S2 from seconds input 55. Logic module 503 has an input M3 from minutes inputs 54 and an input S3 from seconds input 55. Logic module 515 has an input M15 from minutes inputs 54 and an input S15 from seconds input 55. Logic module 559 has an input M59 from minutes inputs 54 and an input S59 from seconds input 55. Logic module 560 has an input M60 from minutes inputs 54 and an input S60 from seconds input 55.

The functionality of minutes decode module 48 in the second embodiment of the invention is the same as the functionality in the first embodiment. The connectivity to the output of latches 49 is different than that of the first embodiment, however, because logic 53 is between latches 49 and electrodes. In step 20 for the second embodiment, if the value of MINUTE_POSITION is greater than the value in minutes register 46, decode module 48 clears the latch driving the logic module (FIG. 14) for the electrode pair in the position indicated by MINUTE_POSITION. The logic modules may be designated module 500+position, so that the module for minute position 1 is 501, the module for minute position 2 is 502, etc. Thus, in step 20 for the second embodiment, if the value of MINUTE_POSITION is greater than the value in minutes register 46, decode module 48 clears the latch driving the minute input of logic module 500+MINUTE POSITION.

In step 30 for the second embodiment, if MINUTE_POSITION is not greater than the value in minutes register 46, decode module 48 writes a 1 into the latch driving the minute input of logic module 500+MINUTE POSITION. (Step 30).

Figure 15:
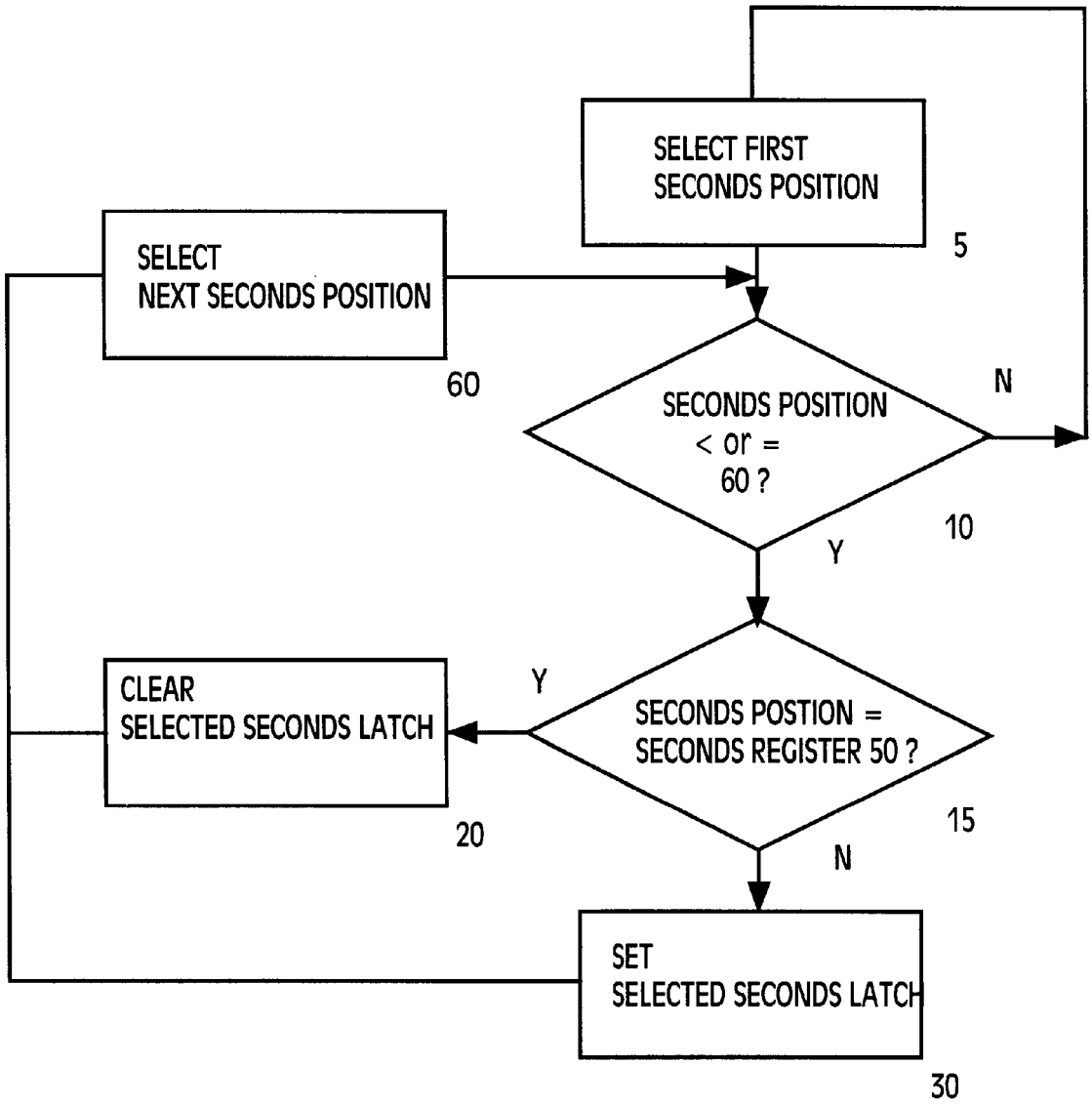
FIG. 15 is a flow chart expressing the functionality of a process performed by the circuitry shown in FIG. 13.

FIG. 15 expresses the functionality of second decode module 51. Decode module 51 selects a first seconds position by setting a variable SECONDS_POSITION equal to 1 (Step 5). Decode module 51 compares the current value of SECONDS_POSITION to 60 (Step 10). If SECONDS_POSITION is less than or equal to 60, decode module 51 compares SECONDS_POSITION to the value in seconds register 50 (Step 15).

The logic modules may be designated module 500+ position, so that the module for minute position 1 is 501, the module for minute position 2 is 502, etc. Thus, in FIG. 15, if the value of SECONDS_POSITION is not equal to the value in seconds register 50, decode module 51 clears the latch driving the seconds input of logic module 500+ SECONDS_POSITION. (step 20).

If SECONDS_POSITION is equal to the value in seconds register 50, decode module 51 writes a 1 into the latch driving the seconds input of logic module 500+SECONDS_POSITION. (Step 30).

Each logic module has an output Oi for driving the outer electrode of one of the electrode pairs, and an output Ii for driving the inner electrode of the respective electrode pair. For example, logic module 501 has an output O1 for driving electrode 401, and an output I1 for driving electrode 301. Logic module 502 has an output O2 for driving electrode 402, and an output I2 for driving electrode 302. Logic module 503 has an output O3 for driving electrode 403, and an output I3 for driving electrode 303. Logic module 515 has an output O15 for driving electrode 415, and an output 115 for driving electrode 315. Logic module 559 has an output O59 for driving electrode 459, and an output 159 for driving electrode 359. Logic module 560 has an output O60 for driving electrode 460.

The output O15 of logic module 515, as a function of inputs M15 and S15, is described in Table 1 below.

TABLE 1

| M15 | S15 | O15 |
|---|---|---|
| 0 | 0 | 0 |
| 0 | 1 | 1 |
| 1 | 0 | 1 |
| 1 | 1 | 1 |

The output 115 of module 515, as a function of inputs M15 and S15, is described in Table 2 below.

TABLE 2

| M15 | S15 | I15 |
|---|---|---|
| 0 | 0 | 0 |
| 0 | 1 | 0 |

TABLE 2-continued

| M15 | S15 | I15 |
|---|---|---|
| 1 | 0 | 1 |
| 1 | 1 | 0 |

In general, the output Oi, as a function of the inputs Mi and Si, is described in Table 3 below.

TABLE 3

| Mi | Si | Oi |
|---|---|---|
| 0 | 0 | 0 |
| 0 | 1 | 1 |
| 1 | 0 | 1 |
| 1 | 1 | 1 |

In general, the output Ii, as a function of the inputs Mi and Si, is shown in Table 4 below.

TABLE 4

| M15 | S15 | I15 |
|---|---|---|
| 0 | 0 | 0 |
| 0 | 1 | 0 |
| 1 | 0 | 1 |
| 1 | 1 | 0 |

Figure 16:
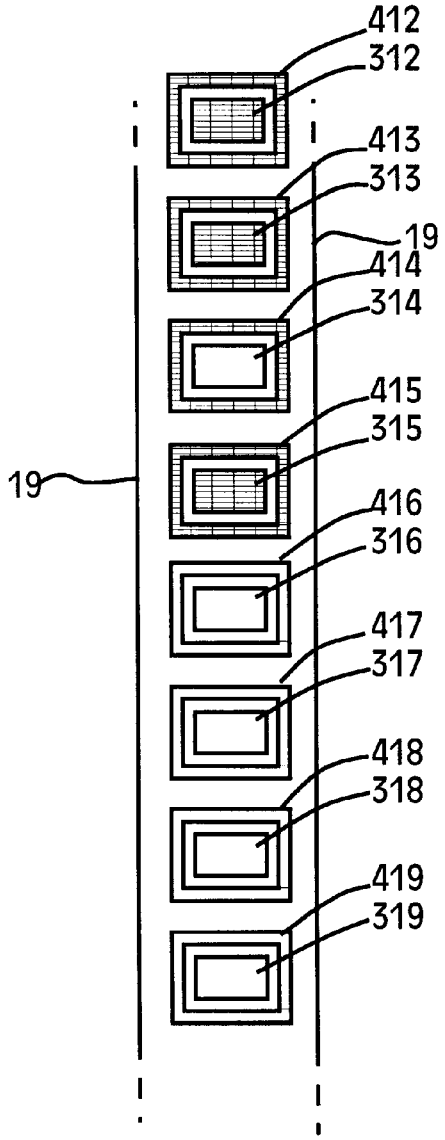
FIG. 16 is a the enlarged view of a portion of the visual display of the second preferred clock displaying a different time than that displayed in FIGS. 11 and 12.

FIG. 16 shows some of the electrodes in electrode group 18, when clock 2 is displaying the time 5:15 AM and 14 seconds (5:15:14).

Figure 17:
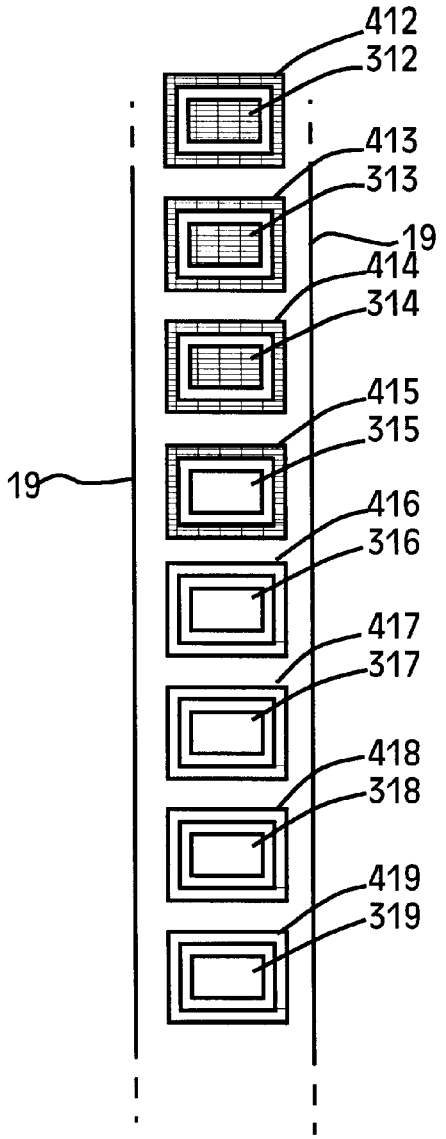
FIG. 17 is a the enlarged view of a portion of the visual display of the second preferred clock displaying yet a different time than that displayed in FIGS. 11 and 12.

FIG. 17 shows some of the electrodes in electrode group 18, when clock 2 is displaying the time 5:15 AM and 15 seconds (5:15:15).

Figure 18:
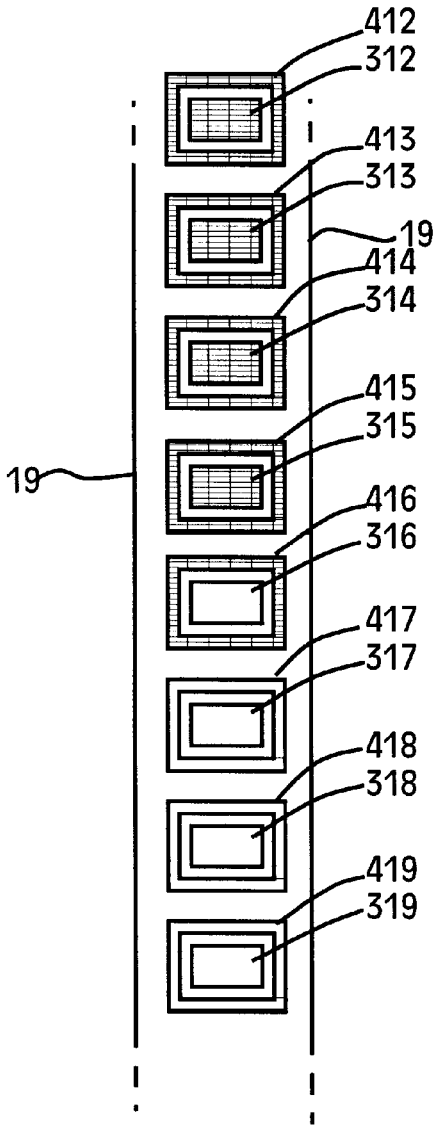
FIG. 18 is a the enlarged view of a portion of the visual display of the second preferred clock displaying yet a different time than that displayed in FIGS. 11 and 12.

FIG. 18 shows some of the electrodes in electrode group 18, when clock 2 is displaying the time 5:15 AM and 16 seconds (5:15:16).

Figure 19:
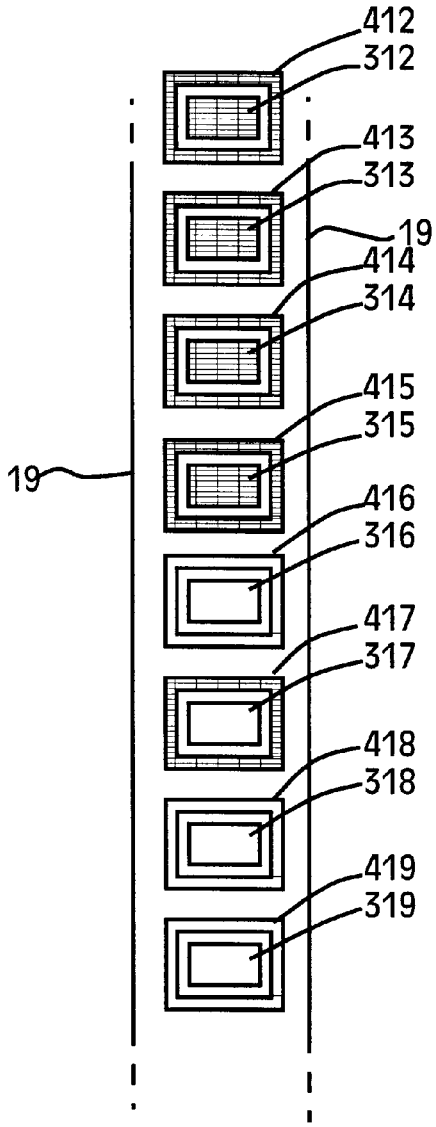
FIG. 19 is a the enlarged view of a portion of the visual display of the second preferred clock displaying yet a different time than that displayed in FIGS. 11 and 12.

FIG. 19 shows some of the electrodes in electrode group 18, when clock 2 is displaying the time 5:15 AM and 17 seconds (5:15:17).

In other words, each inner electrode is a type of display area for displaying minutes. Each outer electrode defines a rectangle. Each outer electrode is a type of display area for displaying seconds. Each outer electrode defines a rectangle completely overlapping a rectangle defined by an inner electrode.

Third Embodiment

Figure 20:
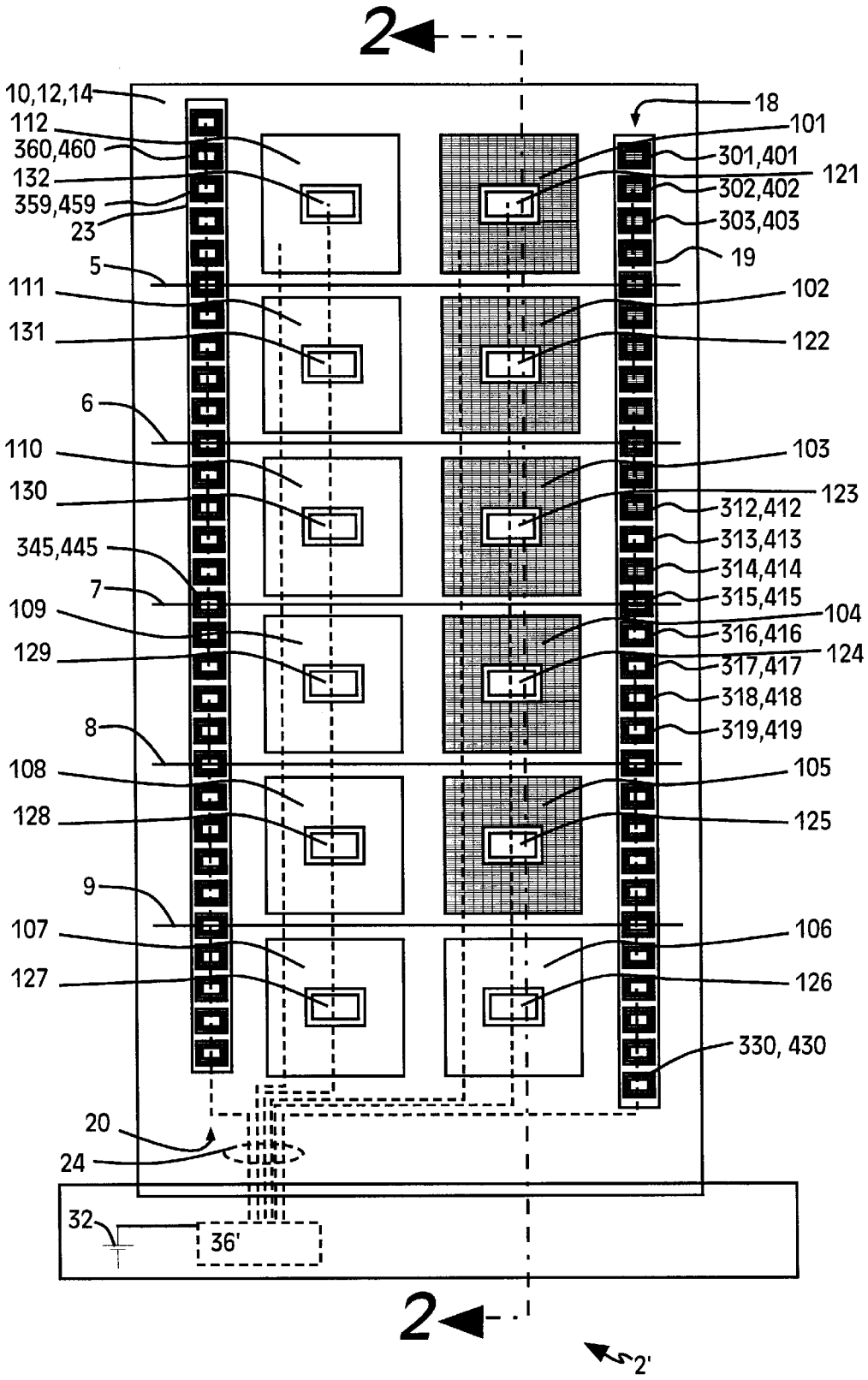
FIG. 20 is a view of a clock in accordance with a third preferred embodiment of the present invention.

FIG. 20 shows clock 2' in accordance with a second, battery powered, embodiment of the present invention. Clock 2' clock is similar to clock 2, except the clock 2' is powered by battery 32, and that power conserving, time processing circuitry 36' drives signal paths 24.

Figure 21:
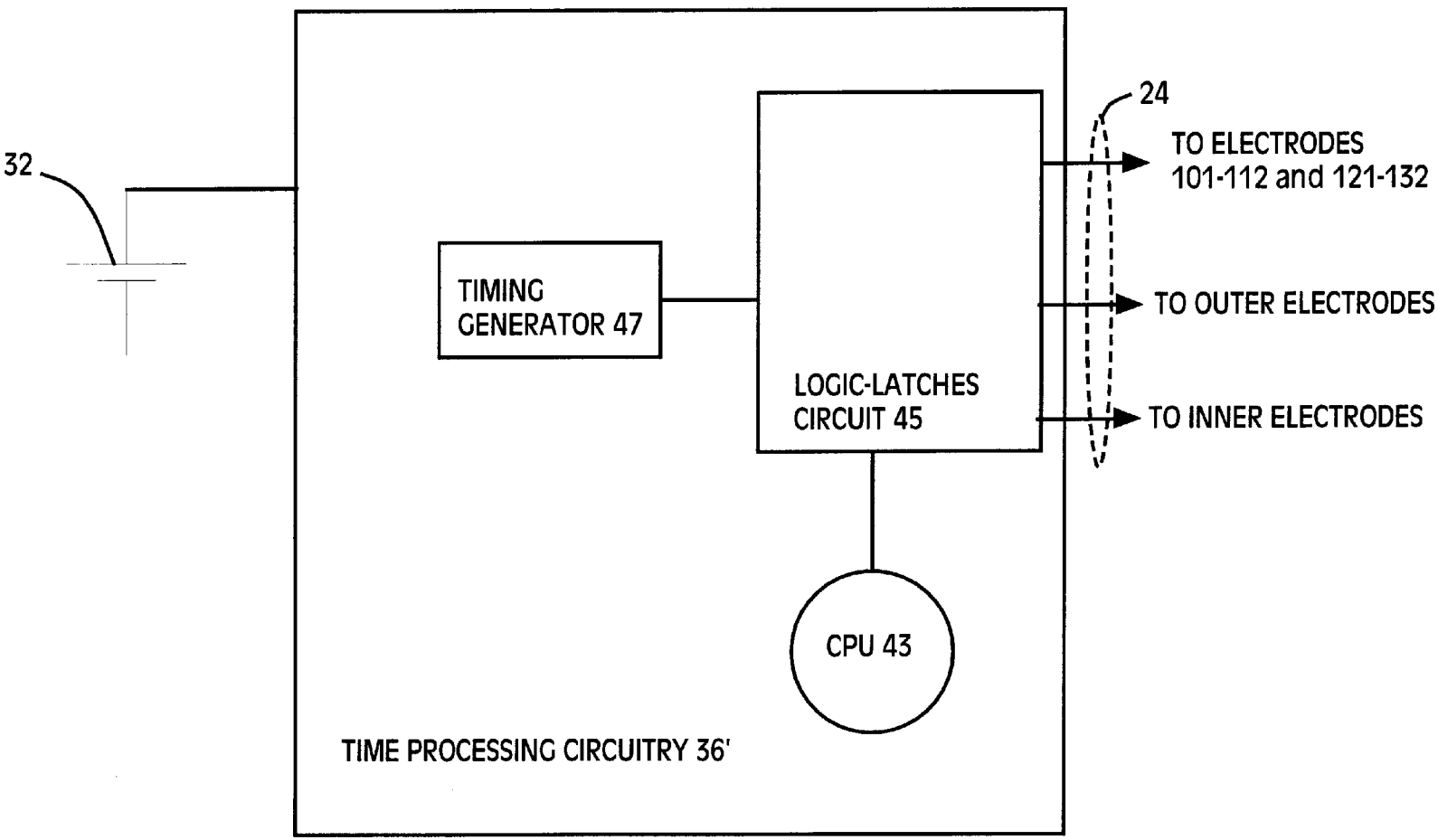
FIG. 21 is a block diagram of some circuitry in the third preferred clock.

FIG. 21 shows time processing circuitry 36' in more detail. CPU 43 is normally in a low power sleep mode, except when the user sets the time using buttons (not shown) on clock 2'. Timing generator 47 applies a clock signal to logic-latches circuit 45. Logic-latches circuit 45 is essentially a state machine implemented with custom hardwired circuitry. In response to a clock cycle from timing generator 47, logic-latches circuit 45 changes one or more voltages going to electrodes 101–112, 121–132, the outer electrodes, or the inner electrodes, to indicate the next increment in time. Time processing circuitry 36' generates the identical signals as those generated by time processing circuitry 36 described above.

In summary, clock 1 includes 12 hour positions corresponding to electrodes 101–112, for indicating the hours 1–12, respectively. Positions 1–6 define a right column, with position 1 at the top of the column and position 6 at the bottom of the column. Positions 7–12 define a left column, with position 7 at the bottom of the column and position 12 at the top of the column. The presence of a rectangle in an hour position indicates that the time is greater than or equal to that hour. For example, the presence of 3 rectangles, in positions 1–3, indicates that the time is at least 3:00.

The specific type of rectangle appearing in an hour position indicates whether the time is AM or PM. A hollow rectangle is the symbol for indicating AM and a solid block is the symbol for indicating PM.

Electrodes 101–106 are essentially a first display part defining a right vertical line. Electrodes 107–112 are essentially a second display part defining a left vertical line, parallel to the vertical line.

Hours decode module 42 acts to generate a signal to cause electrodes 101–106 to indicate time. Hours decode module 48 also acts to generate a signal to cause electrodes 107–112 to indicate time, such that a distance between electrode 101 and the most recently activated one of electrodes 107–112 is a decreasing function of the time.

Although the first and second embodiments of the invention employ discrete contiguous blocks arranged in columns, the invention is not so limited.

Although the first and second embodiments employ a liquid crystal display (LCD), the invention may be practiced with many different types of displays, including multi-color, light emitting display positions.

Although the exemplary embodiments employ discreet positions that make discreet transitions for each increment of time, the invention may be practiced with display positions that gradually change over time.

A pixel-based, portable computing device may be employed, such as a such as a Palm V™ Organizer, for example. The size and shape of display areas may change to indicate changes in time.

Additional advantages and modifications will readily occur to those skilled in the art. The invention in its broader aspects is therefore not limited to the specific details, representative apparatus, and illustrative examples shown and described. Accordingly, departures may be made from such details without departing from the spirit or the scope of Applicants' general inventive concept. The invention is defined in the following claims.

What is claimed is:

1. A clock system comprising:

a first display part with positions for indicating the hours 1–6, including a first position for indicating the hour 1, the first display part defining a first line;

a second display part with positions for indicating the hours 7–12, respectively the second display part defining a second line substantially parallel to the first line, wherein a distance between the first position and the positions of the second display part is a decreasing function of the time corresponding to the positions of the second display part; and a signal generator coupled to the first display part and to the second display part.

2. The clock system of claim 1 wherein the first line is vertically arranged.

3. The clock system of claim 1 further including a third display part with a plurality of positions, the third display part defining a third line;

a fourth display part with a plurality positions, the fourth display part defining a fourth line parallel to the third line.

4. The clock system as in claim 1 wherein the signal generator causes a number of displayed hour symbols to increase as function of time.

5. The clock system of claim 1 wherein the first display part has no numeral prominently displayed for indicating the time.

6. The clock system of claim 1 wherein a center of area of the positions and the first display part define the first vertical line.

7. The clock system of claim 1 wherein the first display part includes 6 positions, and a center of area of the first and second positions defines a first point, a center of area of the fifth and sixth positions defines a second point, and the first and second points define the first line.

8. The clock system of claim 1 wherein the positions of the first display part each display a common symbol.

9. The clock system of claim 1 wherein the signal generator includes circuitry to change the reflectivity of a position to indicate a time.

10. The clock system of claim 9 wherein changing reflectivity includes displaying a picture.

11. The clock system of claim 9 wherein the signal generator maintains the changed reflectivity for positions corresponding to hours less than the current hour.

12. The clock system of claim 1 wherein the signal generator generates a signal to indicate a time by changing an amount of light from a position.

13. A method of operating a clock system including a first display part with a first position for indicating the hour 1, the first display part defining a first line, a second display part with positions for indicating the hours 7–12, the second display part defining a second line substantially parallel to the first line, the method comprising the steps of generating a first signal to cause the first display part to indicate the hours 1–6; and generating a second signal to cause the second display part to indicate time, such that a distance between the first position and the positions of the second display part is a decreasing function of the time corresponding to the positions of the second display part.

14. The method of claim 13 further wherein generating the first signal includes generating the first signal to cause visual changes in the first display part to progress in a vertical direction.

15. The method of claim 13 wherein the clock system further includes a third display part and a fourth display part located such that the first and second display parts are between the third and fourth display parts, and the method further includes generating a third signal to indicate minutes on the third and fourth display part.

16. The method of claim 13 further including generating a fourth signal to indicate seconds on the third and fourth display parts.

17. The method of claim 13 wherein generating the first signal includes generating the first signal to cause the number of displayed hour symbols to increase as function of time.

18. The method of claim 13 wherein generating the first and second signals does not include activating a prominent numeral for indicating the time.

19. The method of claim 13 wherein generating the second signal includes generating the second signal to display a common symbol in positions of the second display part.

20. The method of claim 13 wherein generating the second signal includes generating the second signal to indicate a time by changing an amount of light from a position.

21. The method of claim 20 wherein changing an amount of light includes displaying a picture.

22. The method of claim 20 wherein generating the second signal includes maintaining the changed reflectivity for positions corresponding to hours less than the current hour.

23. A clock system comprising:

a first display part with a first position for indicating the hour 1, the first display part defining a first line;

a second display part with positions for indicating the hours 7–12, the second display part defining a second line substantially parallel to the first line;

means for generating a first signal to cause the first display part to indicate the hours 1–6; and means for generating a second signal to cause the second display to indicate time, such that a distance between the first position and the positions of the second display part is a decreasing function of the time corresponding to the positions of the second display part.

24. The clock system of claim 23 further wherein the means for generating the first signal includes an electrode arrangement to cause visual changes in the first display part to progress in a vertical direction.

25. The clock system of claim 23 wherein the clock system further includes a third display part and a fourth display part located such that the first and second display parts are between the third and fourth display parts, means for generating a third signal to indicate minutes on the third and fourth display part.

26. The clock system of claim 23 further including means for generating a fourth signal to indicate seconds on the third and fourth display parts.

27. The clock system of claim 23 wherein the means for generating the first signal includes logic to cause the number of displayed hour symbols to increase as function of time.

28. A clock system comprising:

a plurality of first display areas for displaying minutes, each first display area defining a first polygon; and a plurality of second display areas for displaying seconds, each second display area defining a polygon overlapping one of the first polygons.

29. The clock system of claim 28 wherein each second display area defines a polygon that completely overlaps one of the first polygons.

30. The clock system of claim 28 wherein each first display area is also for displaying seconds.

31. The clock system of claim 28 wherein a display state of one of the first display areas is a function of the minute of the hour and the second of the minute.

* * * * *